US009283758B2

(12) United States Patent
Horiguchi

(10) Patent No.: US 9,283,758 B2
(45) Date of Patent: Mar. 15, 2016

(54) METHOD OF MANUFACTURING LIQUID JET HEAD, LIQUID JET HEAD, AND LIQUID JET APPARATUS

(71) Applicant: SII PRINTEK INC., Chiba-shi, Chiba (JP)

(72) Inventor: Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/632,144

(22) Filed: Feb. 26, 2015

(65) Prior Publication Data

US 2015/0266294 A1 Sep. 24, 2015

(30) Foreign Application Priority Data

Mar. 19, 2014 (JP) ..... 2014-056447

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/14209* (2013.01); *B41J 2/1607* (2013.01); *B41J 2/1609* (2013.01); *B41J 2/1623* (2013.01); *B41J 2/1632* (2013.01); *B41J 2/1634* (2013.01); *B41J 2/1643* (2013.01); *B41J 2002/14491* (2013.01)

(58) Field of Classification Search
None
See application file for complete search history.

(56) References Cited

U.S. PATENT DOCUMENTS

| | | | | |
|---|---|---|---|---|
| 5,801,731 | A | 9/1998 | Takahashi | 347/69 |
| 2006/0209141 | A1 | 9/2006 | Kojima | 347/85 |
| 2012/0212548 | A1* | 8/2012 | Koseki | B41J 2/1643 347/71 |

FOREIGN PATENT DOCUMENTS

| | | |
|---|---|---|
| EP | 2078610 | 7/2009 |
| EP | 2540503 | 1/2013 |
| JP | 07178903 | 7/1995 |
| JP | 2002210955 | 7/2002 |

OTHER PUBLICATIONS

Intellectual Property Office Search Report issued Sep. 18, 2015 in Appln. No. GB1504670.9.

* cited by examiner

*Primary Examiner* — Bradley Thies
(74) *Attorney, Agent, or Firm* — Adams & Wilks

(57) ABSTRACT

A method of manufacturing a liquid jet head includes: a groove forming step of alternately forming ejection grooves and non-ejection grooves in a reference direction on an upper surface of an actuator substrate; a cover plate processing step of forming a recessed portion on an upper surface of a cover plate and slits penetrating the cover plate from a bottom surface of the recessed portion through a lower surface located opposite to the upper surface of the cover plate; a substrate bonding step of bonding the lower surface of the cover plate to the upper surface of the actuator substrate to allow the slits to communicate with the respective ejection grooves; and an electrode forming step of simultaneously forming conductive films on side surfaces of the ejection grooves, side surfaces of the non-ejection grooves, and inner surfaces of the slits and the recessed portion.

14 Claims, 7 Drawing Sheets

(s1)

(s2)

(s3)

(s5)

(s4)

(s6)

METHOD OF MANUFACTURING LIQUID JET HEAD, LIQUID JET HEAD, AND LIQUID JET APPARATUS

BACKGROUND

1. Technical Field

The present invention relates to a method of manufacturing a liquid jet head which jets liquid droplets onto a recording medium to perform recording, a liquid jet head, and a liquid jet apparatus.

2. Related Art

In recent years, there has been used a liquid jet head of an ink jet system which ejects ink droplets onto, for example, recording paper to record characters or figures thereon, or ejects a liquid material onto the surface of an element substrate to form a functional thin film thereon. In this ink jet system, liquid such as ink and a liquid material is guided from a liquid tank into a channel through a supply tube, and pressure is applied to the liquid filled in the channel to thereby eject the liquid as liquid droplets from a nozzle which communicates with the channel. In the ejection of liquid droplets, characters or figures are recorded, or a functional thin film having a predetermined shape or a three-dimensional structure is formed by moving the liquid jet head or a recording medium.

JP 2002-210955 A describes this type of liquid jet head. FIG. 9 is a schematic cross-sectional view of the liquid jet head (FIG. 2 of JP 2002-210955 A). The liquid jet head is provided with a head chip 110 which ejects ink droplets and an ink manifold member 120 which supplies ink to the head chip 110. The head chip 110 is provided with a channel portion 115. The channel portion 115 is surrounded by two drive walls (not illustrated) each of which is composed of a piezoelectric body, a lower substrate 111, an upper substrate 113, a back plate 119, and a nozzle plate 118. The ink manifold member 120 is provided with an ink flow path 121 and an upper face holding portion 122*a*. The ink manifold member 120 is bonded to the back plate 119 of the head chip 110 with the upper face holding portion 122*a* covering the upper substrate 113 of the head chip 110. Ink flowing into the ink flow path 121 is supplied to the channel portion 115 through an ink introduction port 119*a* of the back plate 119. When the drive walls of the channel portion 115 are driven, ink droplets are ejected through a nozzle hole 118*a*.

A conductive member 117*b* is disposed on the upper substrate 113. The conductive member 117*b* penetrates the upper substrate 113 in the thickness direction thereof. The conductive member 117*b* is electrically connected to drive electrodes disposed on the drive walls which drive the channel portion 115. The upper face holding portion 122*a* is provided with an electrode 123 which penetrates the upper face holding portion 122*a* in the thickness direction thereof. The electrode 123 is disposed at a position corresponding to the conductive member 117*b*. The electrode 123 is electrically connected to the conductive member 117*b* through an electrode 117*c* which is formed on the upper surface of the upper substrate 113. Further, the electrode 123 is electrically connected to an electrode 124 which is formed on an upper surface 120*a* of the ink manifold member 120 so as to be extracted to a back surface 120*b* of the ink manifold member 120. Thus, a drive waveform for driving the drive walls is input to the electrode 124 on the back surface 120*b*, and supplied to the drive electrodes on the drive walls through the electrode 123 disposed on the upper face holding portion 122*a* and the conductive member 117*b* disposed on the upper substrate 113.

JP 7-178903 A describes an ink jet apparatus which includes ejection grooves which are filled with ink and non-ejection grooves which are not filled with ink, the ejection grooves and the non-ejection grooves being alternately arrayed. The ink jet apparatus is provided with a piezoelectric ceramic plate in which the ejection grooves and the non-ejection grooves are alternately formed on the upper surface thereof and a cover plate which is bonded to the piezoelectric ceramic plate to block upper surface openings of both the ejection grooves and the non-ejection grooves. The ejection grooves do not penetrate the piezoelectric ceramic plate and are thus blocked on both the upper and lower sides thereof. The non-ejection grooves penetrate the piezoelectric ceramic plate from the upper surface through the lower surface thereof. Thus, the non-ejection grooves are blocked by the cover plate on the upper side thereof and open on the lower surface of the piezoelectric ceramic plate on the lower side thereof. Metal electrodes are formed on opposite side surfaces of each of the ejection grooves from the upper surface up to half the depth of the groove. Metal electrodes are formed on opposite side surfaces of each of the non-ejection grooves, the lower surface of the cover plate, the lower surface facing the piezoelectric ceramic plate, and the entire lower surface of the piezoelectric ceramic plate. Thus, all the metal electrodes formed on the non-ejection grooves are electrically connected to each other. The metal electrodes of the non-ejection grooves are connected to GND. Further, a drive waveform is applied to the meatal electrodes of the ejection grooves to drive partition walls between the ejection grooves and the non-ejection grooves, thereby ejecting ink droplets from nozzles communicating with the respective ejection grooves.

SUMMARY

In the liquid jet head described in JP 2002-210955 A, the drive electrodes are formed inside the channel portion 115 by electroless plating method. Further, a through hole is formed on the upper substrate 113, and the conductive member 117*b*, for example, silver paste is filled in the through hole. Further, the electrode 117*c* is formed on the upper surface of the upper substrate 113. A through hole is formed also on the upper face holding portion 122*a*, and the electrode 123 is filled in the through hole. Further, a pattern of the electrode 124 is formed from the upper surface 120*a* of the ink manifold member 120 through the back surface 120*b* thereof. Thus, the electrode formation is extremely complicated. In addition, a large number of channel portions 115 are arrayed in the depth direction of the sheet of FIG. 9. Thus, when the head chip 110 and the ink manifold member 120 are bonded to each other, it is necessary to align a large number of electrodes 117*c* with a large number of electrodes 123 with high accuracy and, at the same time, electrically connect the electrodes 117*c* to the electrodes 123. This makes the assembly extremely complicated.

In the ink jet apparatus described in JP 7-178903 A, it is not possible to simultaneously form the metal electrodes on the side surfaces of the ejection grooves and the metal electrodes on the side surfaces of the non-ejection grooves and the lower surface of the piezoelectric ceramic plate. Thus, it is necessary to repeat an electrode forming step a plurality of times. In particular, it is necessary to form the metal electrodes on the side surfaces of the ejection grooves by oblique deposition. Therefore, the electrode formation requires a long time.

A method of manufacturing a liquid jet head of the present invention includes: a groove forming step of alternately forming ejection grooves and non-ejection grooves in a reference direction on an upper surface of an actuator substrate; a cover plate processing step of forming a recessed portion on an upper surface of a cover plate and slits penetrating the cover plate from a bottom surface of the recessed portion through a lower surface of the cover plate; a substrate bonding step of bonding the lower surface of the cover plate to the upper surface of the actuator substrate to allow the slits to communicate with the respective ejection grooves; and an electrode forming step of simultaneously forming conductive films on side surfaces of the ejection grooves, side surfaces of the non-ejection grooves, inner side surfaces of the slits, and an inner surface of the recessed portion.

The substrate bonding step includes bonding the cover plate to the actuator substrate in a manner to allow a part of the upper surface of the actuator substrate and a part of each of the non-ejection grooves to be exposed. The electrode forming step includes simultaneously forming the conductive films on the exposed part of the upper surface of the actuator substrate.

The electrode forming step includes forming the conductive films by plating.

The cover plate processing step includes a step of mirror-finishing the upper surface of the cover plate and roughening the inner surface of the recessed portion and the inner side surfaces of the slits.

The cover plate processing step includes a step of mirror-finishing the lower surface of the cover plate.

The groove forming step includes forming a wiring groove in parallel to the non-ejection grooves. The cover plate processing step includes further forming an additional recessed portion communicating with the recessed portion on the upper surface of the cover plate and an additional slit penetrating the cover plate from a bottom surface of the additional recessed portion through the lower surface opposite to the upper surface of the cover plate. The substrate bonding step includes allowing the additional slit to communicate with the wiring groove. The electrode forming step includes simultaneously forming the conductive films on an inner surface of the wiring groove, an inner surface of the additional recessed portion, and an inner side surface of the additional slit.

The cover plate is a light transmissive substrate.

A liquid jet head of the present invention includes: an actuator substrate having ejection grooves and non-ejection grooves alternately arrayed in a reference direction; a cover plate bonded to the actuator substrate, the cover plate having a recessed portion on an upper surface thereof and slits penetrating the cover plate from a bottom surface of the recessed portion through a lower surface of the cover plate and communicating with the respective ejection grooves; common drive electrodes formed on side surfaces of the ejection grooves; individual drive electrodes formed on side surfaces of the non-ejection grooves; and a common wiring line formed on inner side surfaces of the slits and an inner surface of the recessed portion, wherein the common drive electrodes formed on the ejection grooves are electrically connected to each other through the common wiring line.

The non-ejection grooves are formed from a first end of the actuator substrate through a second end thereof. The ejection grooves are formed from the first end of the actuator substrate up to the vicinity of the second end thereof. The cover plate is bonded to an upper surface of the actuator substrate in a manner to allow the slits to communicate with the respective ejection grooves. Individual terminals are formed on the upper surface of the actuator substrate near the second end thereof. Each of the individual terminals is configured to electrically connect each two of the individual drive electrodes formed on each two of the non-ejection grooves adjacent to each other with each of the ejection grooves interposed therebetween.

The inner surface of the recessed portion and the inner side surfaces of the slits are roughened.

The actuator substrate includes a wiring groove formed near an end in the reference direction, a wiring electrode formed on an inner surface of the wiring groove, and a common terminal formed on the upper surface on which the wiring groove is open. The cover plate includes an additional recessed portion communicating with the recessed portion, an additional slit penetrating the cover plate from a bottom surface of the additional recessed portion through the lower surface of the cover plate and communicating with the additional recessed portion, and an additional wiring line formed on an inner surface of the additional recessed portion and an inner side surface of the additional slit. The common terminal is electrically connected to the common wiring line through the wiring electrode and the additional wiring line.

The actuator substrate includes individual terminals electrically connected to the individual drive electrodes and a common terminal electrically connected to the common wiring line. The common terminal is formed on an upper surface of the actuator substrate on an end in the reference direction. The individual terminals are formed on the upper surface of the actuator substrate on an inner side in the reference direction with respect to the common terminal.

The cover plate is a light transmissive substrate.

A liquid jet apparatus of the present invention includes: the liquid jet head described above; a movement mechanism configured to relatively move the liquid jet head and a recording medium; a liquid supply tube configured to supply liquid to the liquid jet head; and a liquid tank configured to supply the liquid to the liquid supply tube.

Effect of Invention

The method of manufacturing the liquid jet head according to the present invention includes: a groove forming step of alternately forming ejection grooves and non-ejection grooves in a reference direction on an upper surface of an actuator substrate; a cover plate processing step of forming a recessed portion on an upper surface of a cover plate and slits penetrating the cover plate from a bottom surface of the recessed portion through a lower surface of the cover plate; a substrate bonding step of bonding the lower surface of the cover plate to the upper surface of the actuator substrate to allow the slits to communicate with the respective ejection grooves; and an electrode forming step of simultaneously forming conductive films on side surfaces of the ejection grooves, side surfaces of the non-ejection grooves, inner side surfaces of the slits, and an inner surface of the recessed portion. As a result, the conductive films formed on the ejection grooves are electrically connected to each other through the conductive film formed on the inner side surfaces of the slits and the inner surface of the recessed portion. Therefore, the electrode forming step is extremely simplified.

DETAILED DESCRIPTION

First Embodiment

Figure 1:
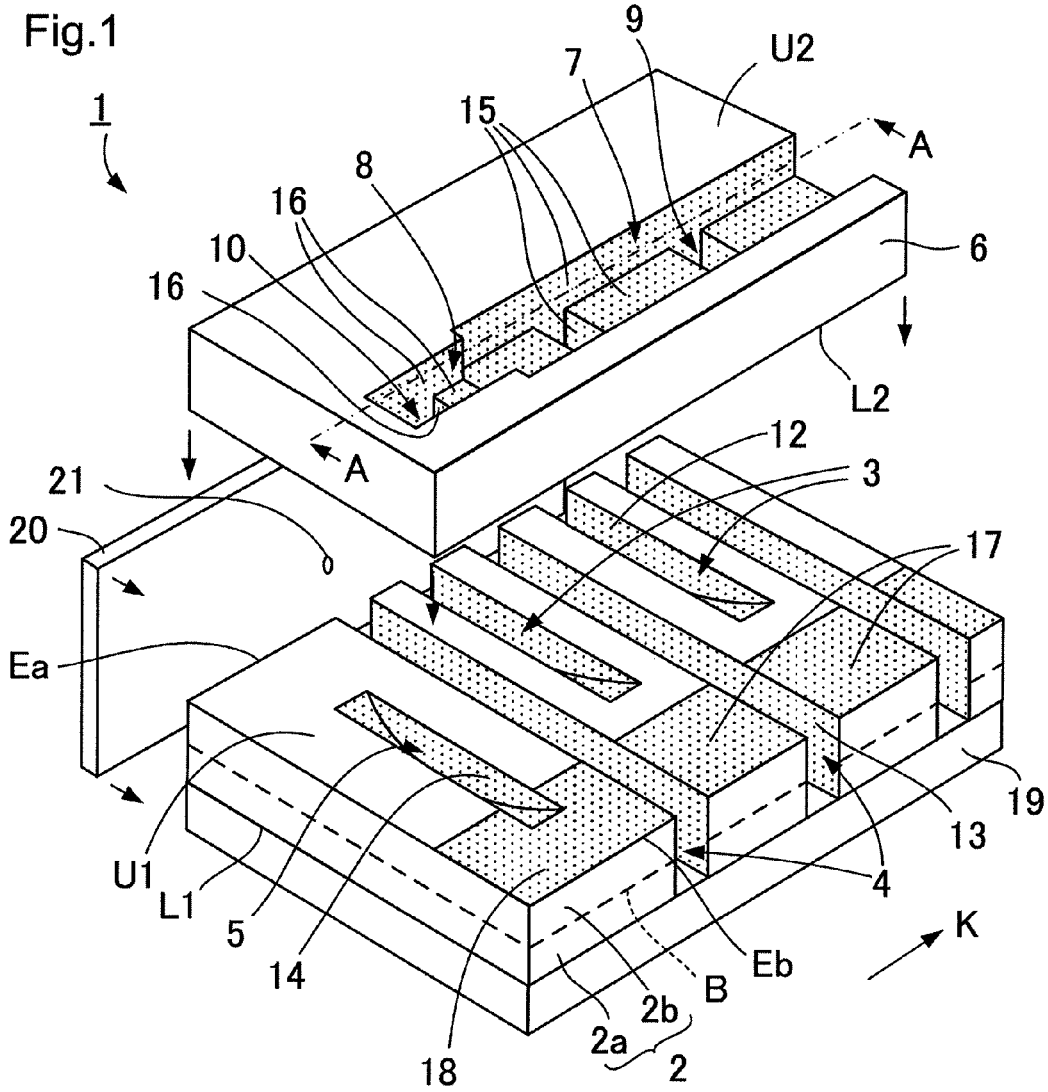
FIG. 1 is an explanatory diagram of a liquid jet head according to a first embodiment of the present invention.
Figure 2:
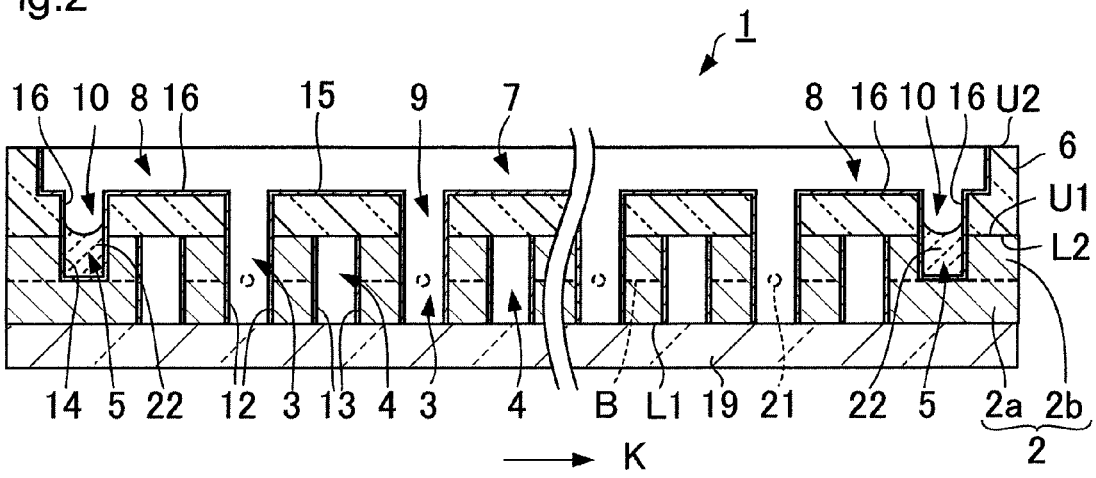
FIG. 2 is an explanatory diagram of the liquid jet head according to the first embodiment of the present invention.

FIGS. 1 and 2 are explanatory diagrams of a liquid jet head 1 according to a first embodiment of the present invention. FIG. 1 is a partial schematic exploded perspective view of the liquid jet head 1. In FIG. 1, dotted regions indicate regions in which electrodes are formed (the same applies to the other drawings). FIG. 2 is a schematic vertical cross-sectional view of the liquid jet head 1 taken along line A-A illustrated in FIG. 1. FIG. 2 illustrates a region in an actuator substrate 2 in which the depth of ejection grooves 3 is equal to the depth of non-ejection grooves 4 and the liquid jet head 1 from one end through the other end thereof in a reference direction K.

The liquid jet head 1 is provided with the actuator substrate 2, a cover plate 6 which is bonded to the actuator substrate 2, a reinforcing plate 19 which is disposed on the actuator substrate 2 on the opposite side of the cover plate 6, and a nozzle plate 20 which is disposed on an end surface of the actuator substrate 2. The actuator substrate 2 includes the ejection grooves 3 and the non-ejection grooves 4 which are alternately arrayed in the reference direction K. The cover plate 6 includes a recessed portion 7 which is formed on an upper surface U2 thereof and slits 9 which penetrate the cover plate 6 from a bottom surface of the recessed portion 7 through a lower surface L2 of the cover plate 6, the lower surface L2 being located opposite to the upper surface U2, and communicate with the respective ejection grooves 3. Common drive electrodes 12 are formed on opposite side surfaces of each of the ejection grooves 3. Individual drive electrodes 13 are formed on opposite side surfaces of each of the non-ejection grooves 4. A common wiring line 15 is formed on inner side surfaces of the slits 9 and an inner surface of the recessed portion 7. The common drive electrodes 12 formed on the ejection grooves 3 are electrically connected to each other through the common wiring line 15.

Specifically, the actuator substrate 2 is a so-called chevron type substrate in which a piezoelectric substrate 2*a* polarized in the normal direction of the substrate surfaces and a piezoelectric substrate 2*b* polarized in an opposite direction of the piezoelectric substrate 2*a* are laminated. A boundary B between the piezoelectric substrate 2*a* and the piezoelectric substrate 2*b* is located at approximately half the depth of the ejection grooves 3 or the non-ejection grooves 4. The non-ejection grooves 4 are formed from an end Ea on a first side (first end Ea) of the actuator substrate 2 through an end Eb on a second side (second end Eb) thereof. The ejection grooves 3 are formed from the first end Ea of the actuator substrate 2 up to the vicinity of the second end Eb. The cover plate 6 is bonded to an upper surface U1 of the actuator substrate 2 in a manner to allow the slits 9 to communicate with the respective ejection grooves 3. That is, the cover plate 6 is bonded to the actuator substrate 2 in a manner to cover the ejection grooves 3 excepting the slits 9 and to allow the upper surface U1 to be exposed near the second end Eb. Individual terminals 17 are formed on the upper surface U1 of the actuator substrate 2 at positions near the second end Eb thereof. Each of the individual terminals 17 electrically connects each two of the individual drive electrodes 13 formed on side surfaces of each two of the non-ejection grooves 4 that are adjacent to each other with each of the ejection grooves 3 interposed therebetween, the side surfaces being located on side walls that defines the interposed ejection groove 3.

The actuator substrate 2 is further provided with wiring grooves 5 which are formed in parallel to the non-ejection grooves 4 near the opposite ends in the reference direction K of the actuator substrate 2, wiring electrodes 14 which are formed on the inner surfaces of the respective wiring grooves 5, and common terminals 18 which are formed on the upper surface U1 on which the wiring grooves 5 are open. The cover plate 6 is provided with additional recessed portions 8 which communicate with the recessed portion 7, additional slits 10 each of which penetrates the cover plate 6 from the bottom surface of the corresponding additional recessed portion 8 through the lower surface L2 and communicates with the corresponding recessed portion 8, and additional wiring lines 16 each of which is formed on the inner surface of the corresponding additional recessed portion 8 and the inner side surface of the additional slit 10. The common terminals 18 are electrically connected to the common wiring line 15 through the respective wiring electrodes 14 and the respective additional wiring lines 16. Only a single wiring groove 5 may be formed on the actuator substrate 2 near one end in the reference direction K thereof.

Thus, the common terminals 18 are electrically connected to the common drive electrodes 12 and formed on the upper surface U1 of the actuator substrate 2 on the opposite ends in the reference direction K thereof. The individual terminals 17 are electrically connected to the individual drive electrodes 13 and formed on the upper surface U1 of the actuator substrate 2 on the inner side in the reference direction K with respect to the common terminals 18. Only a single common terminal 18 may be formed on one end in the reference direction K of the actuator substrate 2. Forming the common terminals 18 on the ends of the actuator substrate 2 in this manner makes it possible to increase the electrode width of the common terminals 18 without any restriction caused by the pitch of the ejection grooves 3 or the non-ejection grooves 4.

The nozzle plate 20 is provided with nozzles 21 which communicate with the respective ejection grooves 3 and adhered to the end surface on the first end Ea of the actuator substrate 2. The reinforcing plate 19 is disposed on the lower surface L1 of the actuator substrate 2 and blocks opening portions formed by the ejection grooves 3 and the non-ejection grooves 4 open on the lower surface L1. The additional recessed portions 8 and the additional slits 10 or the wiring grooves 5 are desirably sealed with, for example, an adhesive 22 as illustrated in FIG. 2 after the formation of the additional wiring lines 16 and the wiring electrodes 14 to prevent liquid filled in the recessed portion 7 from leaking to the outside. The individual terminals 17 and the common terminals 18 are electrically connected to a drive circuit through wiring of a flexible circuit board (not illustrated).

A piezoelectric material such as PZT ceramics maybe used as the actuator substrate 2. A PZT ceramic material, another insulating material, a plastic material, or a light transmissive substrate, for example, a glass material may be used as the cover plate 6. When a light transmissive glass material is used as the cover plate 6, it is possible to repair failure in the common drive electrodes 12 formed on the ejection grooves 3 or the individual drive electrodes 13 formed on the non-ejection grooves 4 by laser processing after the cover plate 6 is bonded to the actuator substrate 2. A plastic material such as a polyimide film may be used as the nozzle plate 20. The reinforcing plate 19 is disposed as necessary. For example, the piezoelectric substrate 2*a* may be formed to be thick, and the ejection grooves 3 and the non-ejection grooves 4 may be formed up to a necessary depth in the piezoelectric substrate 2*a*.

When the inner surface of the recessed portion 7 and the inner side surfaces of the slits 9 are roughened and a conductive film is formed by electroless plating method, it is possible to simultaneously form the common wiring line 15, the common drive electrodes 12, and the individual drive electrodes 13. When the inner surface of the recessed portion 7 and the inner side surfaces of the slits 9 are roughened, apart of the upper surface U1 of the actuator substrate 2 near the second end Eb is roughened by, for example, sandblast, and conductive films are then formed by electroless plating method, it is possible to simultaneously form the common wiring line 15, the common drive electrodes 12, the individual drive electrodes 13, and the individual terminals 17. When the additional recessed portions 8 which communicate with the recessed portion 7 and the additional slits 10 each of which penetrates the cover plate 6 from the bottom surface of the corresponding recessed portion 8 through the lower surface L2 of the cover plate 6, and conductive films are then formed by electroless plating method, it is possible to simultaneously form the common terminals 18 which are electrically connected to the common wiring line 15 with the other electrodes. The upper surface U2 and an end surface corresponding to the second end Eb of the cover plate 6 are mirror-finished. Accordingly, when the conductive films are formed by electroless plating method, no conductive film is formed on the upper surface U2 and the end surface corresponding to the second end Eb of the cover plate 6.

The liquid jet head 1 operates in the following manner. Liquid is supplied from a liquid storage portion (not illustrated) to the recessed portion 7 through a flow path member (not illustrated). The liquid is filled into the ejection grooves 3 through the respective slits 9. Then, GND potential is applied to the common terminals 18, and a drive waveform is applied to the individual terminals 17. Accordingly, the common drive electrodes 12 of the ejection grooves 3 have the GND potential. The drive waveform is transmitted to each two of the individual drive electrodes 13 formed on each two of the non-ejection grooves 4 between which each of the ejection grooves 3 is interposed, the two individual drive electrodes 13 being located on side walls that define the interposed ejection groove 3, to cause the thickness-slide deformation of the opposite side walls of the interposed ejection grooves 3. For example, the opposite side walls of each of the ejection grooves 3 is deformed to increase the volume of the ejection groove 3 to thereby introduce liquid from the recessed portion 7. Then, the opposite side walls are deformed to return to their initial positions or deformed to make the volume of the ejection groove 3 smaller than the initial volume thereof to thereby eject liquid droplets through the corresponding nozzle 21.

The liquid jet head 1 in the present embodiment is an edge shoot type liquid jet head in which the nozzle plate 20 is disposed on the first end Ea of the actuator substrate 2. However, instead of this, the liquid jet head 1 may be a side shoot type liquid jet head in which the nozzle plate 20 is disposed on the lower surface L1 of the actuator substrate 2. In this case, the ejection grooves 3 of the actuator substrate 2 are formed from the vicinity of the first end Ea up to the vicinity of the second end Eb. Further, a recessed portion and slits which penetrate the cover plate 6 from the bottom surface of the recessed portion through the lower surface L2 are formed on the upper surface U2 of the cover plate 6 near an end on the first side thereof, and the slits are allowed to communicate with ends on the first side of the respective ejection grooves 3. A common electrode similar to the common wiring line 15 may be formed on the inner surface of the recessed portion and the inner side surfaces of the slits. The nozzle plate 20 is disposed on the lower surface L1 instead of the reinforcing plate 19. In this case, for example, the nozzle plate 20 made of a glass material enables the individual drive electrodes 13 opposed in each of the non-ejection grooves 4 to be electrically separated from each other.

Second Embodiment

Figure 3:
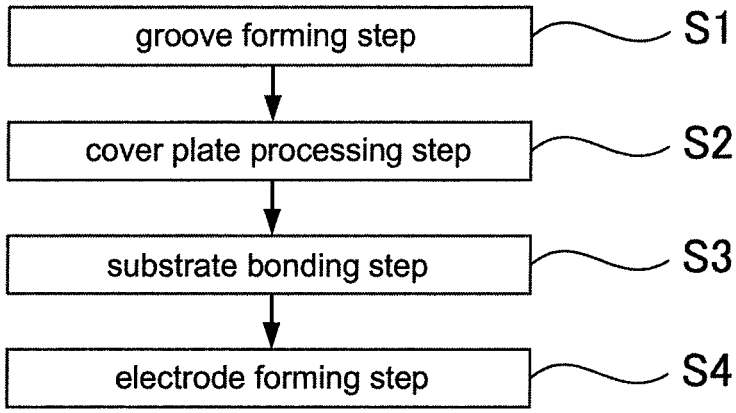
FIG. 3 is a flow chart illustrating a method of manufacturing a liquid jet head according to a second embodiment of the present invention.

FIG. 3 is a flow chart illustrating a method of manufacturing a liquid jet head 1 according to a second embodiment of the present invention. The second embodiment shows a basic method of manufacturing the liquid jet head 1 according to the present invention. Identical elements or elements having identical functions will be designated by the same reference numerals.

Hereinbelow, FIG. 3 will be described with reference to FIG. 1. The method of manufacturing the liquid jet head 1 of the present invention includes a groove forming step S1 of forming ejection grooves 3 and non-ejection grooves 4 on an actuator substrate 2, a cover plate processing step S2 of forming a recessed portion 7 and slits 9 on a cover plate 6, a substrate bonding step S3 of bonding the cover plate 6 and the actuator substrate 2 to each other, and an electrode forming step S4 of forming conductive films (corresponding to the common drive electrodes 12, the individual drive electrodes 13, and the common wiring line 15 in FIG. 1). In the groove forming step S1, the ejection grooves 3 and the non-ejection grooves 4 are alternately formed in a reference direction K on an upper surface U1 of the actuator substrate 2. In the cover plate processing step S2, the recessed portion 7 is formed on an upper surface U2 of the cover plate 6. Further, the slits 9 which penetrate the cover plate 6 from the bottom surface of the recessed portion 7 through a lower surface L2 located opposite to the upper surface U2 is formed on the cover plate 6. In the substrate bonding step S3, the lower surface L2 of the cover plate 6 is bonded to the upper surface U1 of the actuator substrate 2 to allow the slits 9 to communicate with the respective ejection grooves 3.

In the electrode forming step S4, conductive films 11 are simultaneously formed on the side surfaces of the ejection grooves 3, the side surfaces of the non-ejection grooves 4, the inner side surfaces of the slits 9, and the inner surface of the recessed portion 7. That is, in FIG. 1, the common drive electrodes 12 on the side surfaces of the ejection grooves 3, the individual drive electrodes 13 on the side surfaces of the non-ejection grooves 4, the common wiring line 15 on the inner side surfaces of the slits 9 and the inner surface of the recessed portion 7 are simultaneously formed. As a result, the conductive films 11 (the common drive electrodes 12) formed on the ejection grooves 3 are electrically connected to each other through the conductive film 11 (the common wiring line 15) formed on the inner side surfaces of the slits 9 and the inner surface of the recessed portion 7. Therefore, the electrode forming step S4 is extremely simplified.

Third Embodiment

Figure 4:
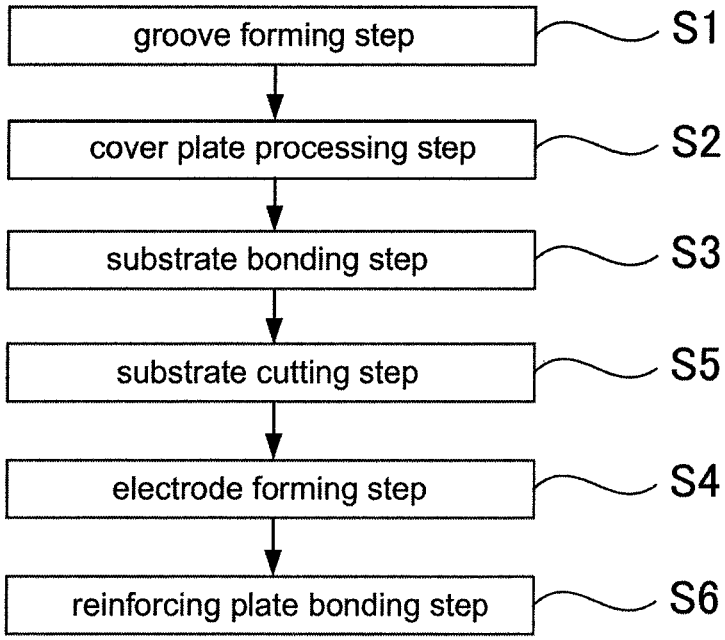
FIG. 4 is a flow chart illustrating a method of manufacturing a liquid jet head according to a third embodiment of the present invention.
Figure 5:
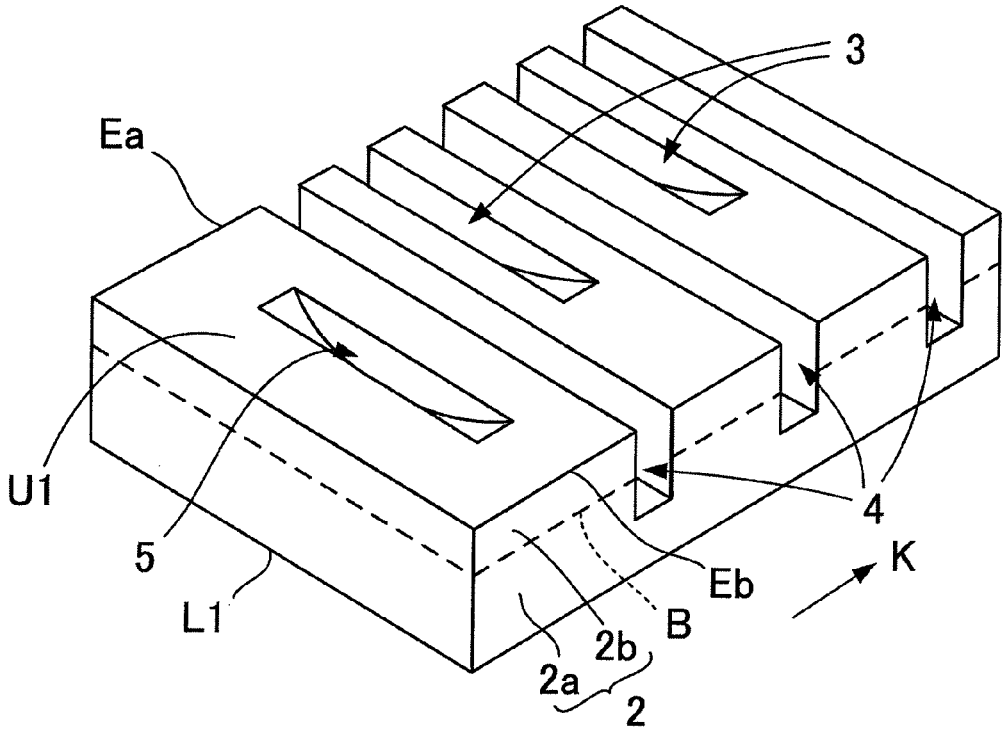
FIG. 5 is an explanatory diagram of the method of manufacturing the liquid jet head according to the third embodiment of the present invention.
Figure 5:
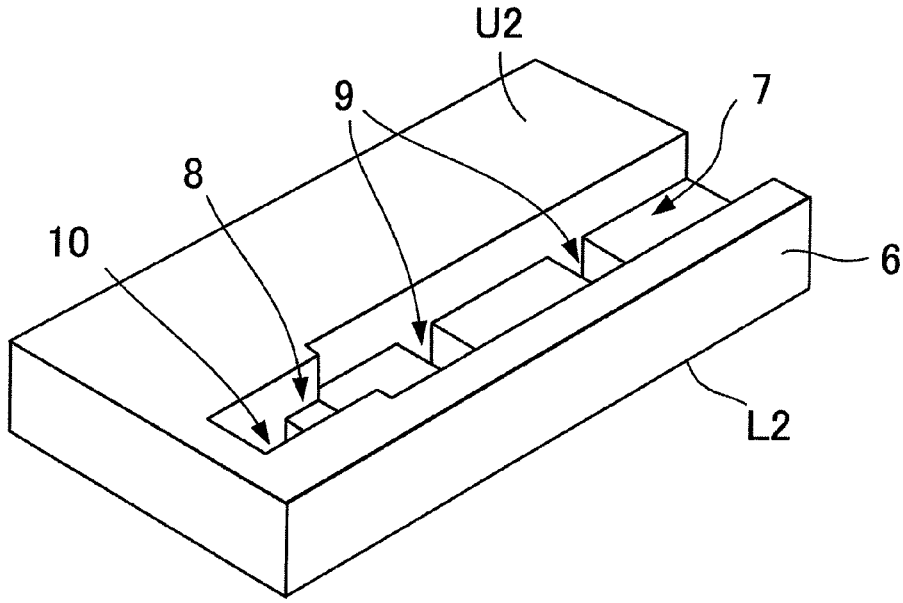
Figure 6:
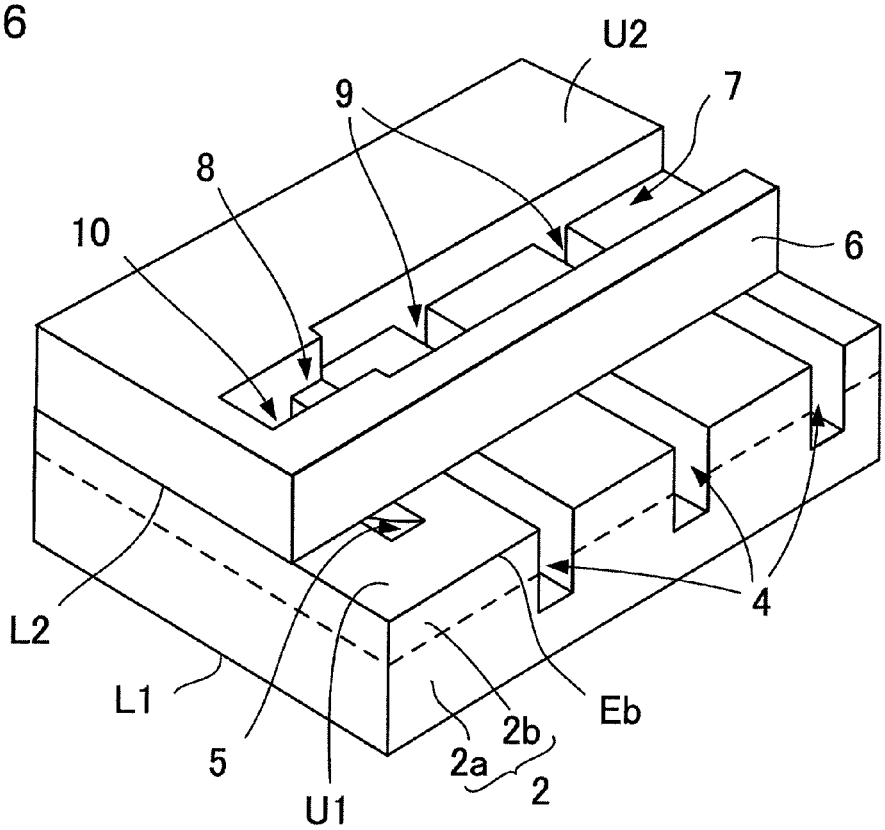
FIG. 6 is an explanatory diagram of the method of manufacturing the liquid jet head according to the third embodiment of the present invention.
Figure 6:
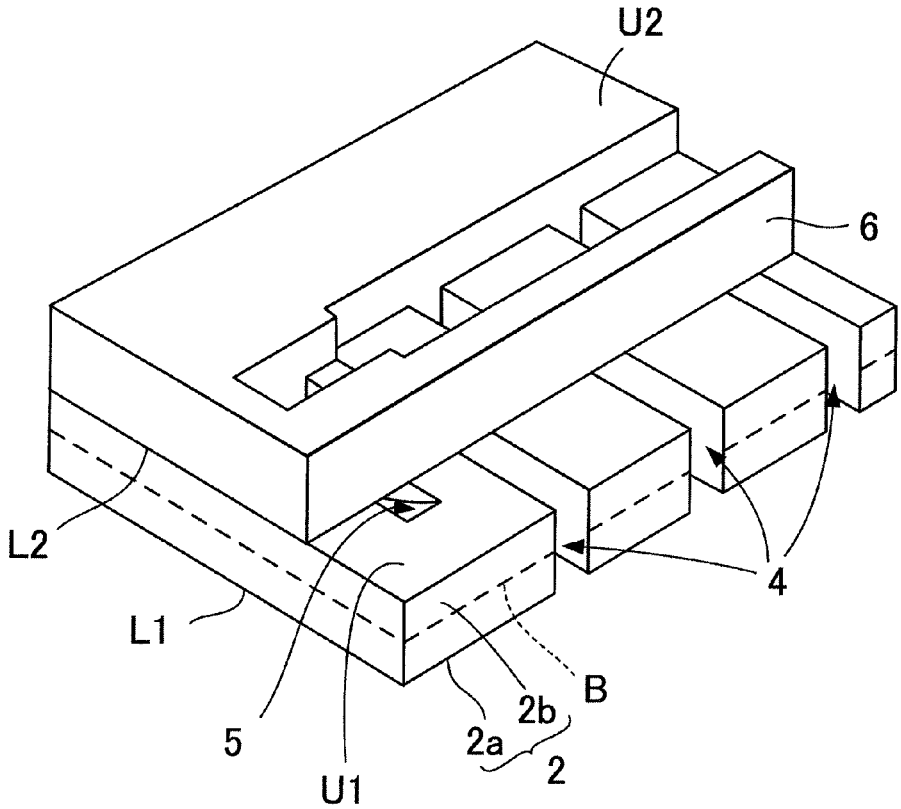
Figure 7:
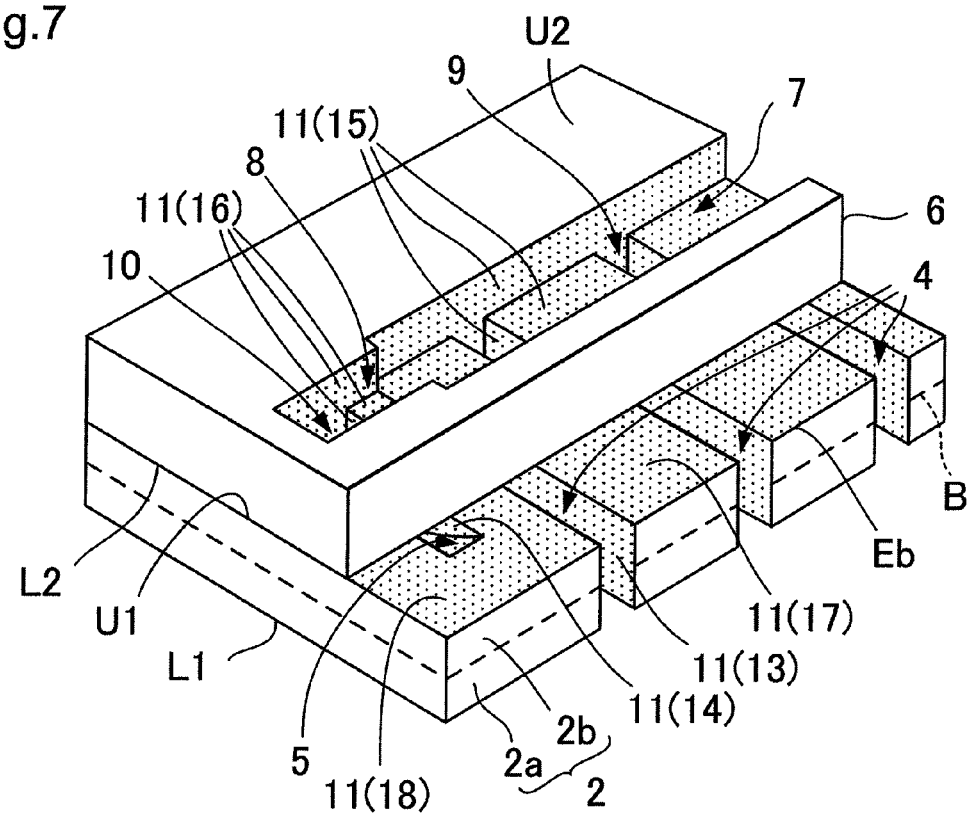
FIG. 7 is an explanatory diagram of the method of manufacturing the liquid jet head according to the third embodiment of the present invention.
Figure 7:
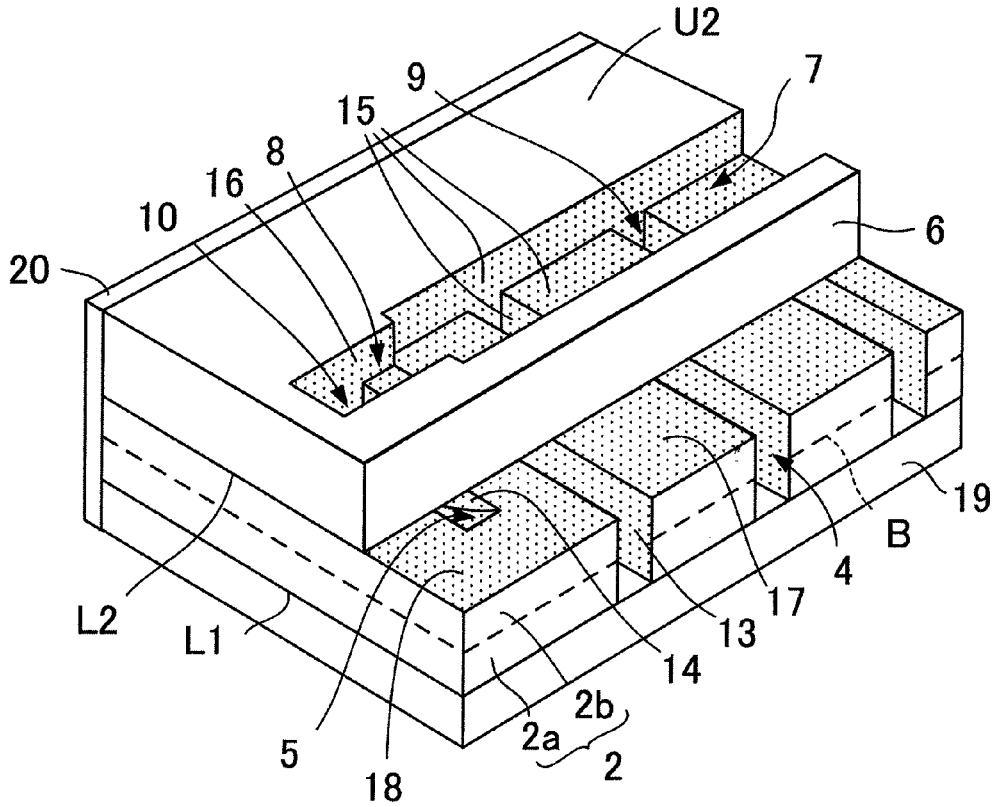

FIG. 4 is a flow chart illustrating a method of manufacturing a liquid jet head 1 according to a third embodiment of the present invention. FIGS. 5 to 7 are explanatory diagrams of the method of manufacturing the liquid jet head 1 according to the third embodiment of the present invention. Identical elements or elements having identical functions will be designated by the same reference numerals.

As illustrated in FIG. 4, the method of manufacturing the liquid jet head 1 of the present invention includes a groove forming step S1 of forming ejection grooves 3 and non-ejection grooves 4 on an actuator substrate 2, a cover plate processing step S2 of forming a recessed portion 7 and slits 9 on a cover plate 6, a substrate bonding step S3 of bonding the cover plate 6 and the actuator substrate 2 to each other, a substrate cutting step S5 of cutting a lower surface L1 of the actuator substrate 2, the lower surface L1 being located opposite to the upper surface U1, an electrode forming step S4 of forming conductive films 11, and a reinforcing plate bonding step S6 of bonding a reinforcing plate 19 to the lower surface L1 of the actuator substrate 2. Thus, the manufacturing method of the second embodiment further includes the substrate cutting step S5 and the reinforcing plate bonding step S6 in addition to the manufacturing method of the second embodiment. As with the second embodiment, the conductive films 11 formed on the ejection grooves 3 are electrically connected to each other through the conductive film 11 formed on the inner side surfaces of the slits 9 and the inner surface of the recessed portion 7. Accordingly, the electrode forming step S4 is extremely simplified. Further, the method of the third embodiment introduces the substrate cutting step S5. Thus, the electrode forming step S4 is performed with the ejection grooves 3 and the non-ejection grooves 4 open on the lower surface L1 of the actuator substrate 2. This makes it easy to form the conductive films 11 on the side surfaces of the ejection grooves 3 and the side surfaces of the non-ejection grooves 4. Hereinbelow, the method of the third embodiment will be specifically described.

As illustrated in FIG. 5 (s1), in the groove forming step S1, the ejection grooves 3 and the non-ejection grooves 4 are alternately formed in the reference direction K on the upper surface U1 of the actuator substrate 2. A chevron substrate which is made of a piezoelectric material such as PZT ceramics and polarized in different directions up and down is used as the actuator substrate 2. That is, a laminated substrate in which a piezoelectric substrate 2*a* polarized in the normal direction of the substrate surfaces and a piezoelectric substrate 2*b* polarized in an opposite direction of the piezoelectric substrate 2*a* are laminated is used as the actuator substrate 2. The ejection grooves 3 and the non-ejection grooves 4 may be formed by cutting the actuator substrate 2 using a dicing blade (also referred to as a diamond blade) which is a discoid blade having abrasive grains embedded on the outer periphery thereof. The ejection grooves 3 are formed by cutting the upper surface U1 of the actuator substrate 2 from an end Ea on a first side (the first end Ea) up to the vicinity of an end Eb on a second side (the second end Eb) thereof. The non-ejection grooves 4 are formed by straightly cutting the upper surface U1 of the actuator substrate 2 from the first end Ea through the second end Eb. In the cutting, the width of each of the grooves is 20 μm to 200 μm, and the final depth of each of the grooves is 150 μm to 700 μm. Further, a boundary B between the piezoelectric substrate 2*a* and the piezoelectric substrate 2*b* is located at half the final depth of each of the grooves.

In the groove forming step S1, a wiring groove 5 is further formed on the upper surface U1 of the actuator substrate 2 near an end in the reference direction K as well as near the second end Eb in parallel to the non-ejection grooves 4. The wiring groove 5 is formed to be shallower than the non-ejection grooves 4. The wiring groove 5 may extend up to the second end Eb of the actuator substrate 2. The piezoelectric substrate 2*a* is left under the ejection grooves 3 and the non-ejection grooves 4 after the formation of the ejection grooves 3 and the non-ejection grooves 4 to ensure the strength of the actuator substrate 2.

As illustrated in FIG. 5 (s2), in the cover plate processing step S2, the recessed portion 7 is formed on the upper surface U2 of the cover plate 6. Further, the slits 9 which penetrate the cover plate 6 from the bottom surface of the recessed portion 7 through the lower surface L2 located opposite to the upper surface U2 is formed on the over plate 6. A PZT ceramic material, another ceramic material, an insulating material, a glass material, or a plastic material having a linear expansion coefficient comparable to the linear expansion coefficient of the actuator substrate 2 may be used as the cover plate 6. The recessed portion 7 and the slits 9 may be formed, for example, by sandblast or etching.

The cover plate processing step S2 includes a step of mirror-finishing the upper surface U2 of the cover plate 6 and roughening the inner surface of the recessed portion 7 and the inner side surfaces of the slits 9. For example, when the recessed portion 7 and the slits 9 are formed by sandblast, the inner surface of the recessed portion 7 and the inner side surfaces of the slits 9 are roughened. Accordingly, the conductive film 11 is easily deposited by electroless plating method. Further, when the upper surface U2 and the lower surface L2 of the cover plate 6 are mirror-finished, no conductive film 11 is deposited even when the upper surface U2 and the lower surface L2 are immersed in an electroless plating solution. The cover plate processing step S2 further includes a step of forming an additional recessed portion 8 which communicates with the recessed portion 7 on the upper surface U2 of the cover plate 6 and an additional slit 10 which penetrates the cover plate 6 from the bottom surface of the recessed portion 8 through the lower surface L2 located opposite to the upper surface U2 of the cover plate 6. Then, the inner side surface of the additional slit 10 and the inner surface of the additional recessed portion 8 are roughened in the same manner as the inner side surfaces of the slits 9 and the inner surface of the recessed portion 7.

Then, as illustrated in FIG. 6 (s3), in the substrate bonding step S3, the lower surface L2 of the cover plate 6 is bonded to the upper surface U1 of the actuator substrate 2 with an adhesive to allow the slits 9 to communicate with the respective ejection grooves 3 and, at the same time, to allow the additional slit 10 to communicate with the wiring groove 5. In the substrate bonding step S3, the cover plate 6 is bonded to the actuator substrate 2 in a manner to allow the upper surface U1 of the actuator substrate 2 and the non-ejection grooves 4 to be exposed near the second end Eb. The end surface corresponding to the second end Eb of the cover plate 6 is desirably mirror-finished. Further, the exposed part of the upper surface U1 of the actuator substrate 2 near the second end Eb is roughened.

Then, as illustrate in FIG. 6 (s5), in the substrate cutting step S5, the lower surface L1 of the actuator substrate 2 is cut to allow the ejection grooves 3 and the non-ejection grooves 4 to be open on the lower surface L1. After the cutting, the lower surface L1 is mirror-finished to prevent the deposition of the conductive film 11 when the lower surface L1 is immersed in the electroless plating solution. The upper part of each of the side walls of the ejection grooves 3 and the non-ejection grooves 4 is fixed by the cover plate 6. Thus, even when the bottoms of the grooves are open, the side walls are not separated into pieces. Opening the bottoms of the ejection grooves 3 and the non-ejection grooves 4 makes the deposition of the conductive films 11 in the next step easy. The lower surface L1 is cut in a manner to allow the boundary B between the piezoelectric substrate 2*a* and the piezoelectric substrate 2*b* to be located at half the depth of the grooves.

Then, as illustrate in FIG. 7 (s4), in the electrode forming step S4, the conductive films 11 are simultaneously formed on the side surfaces of the ejection grooves 3, the side surfaces of the non-ejection grooves 4, the inner surface (the side surface and the bottom surface) of the wiring groove 5, the inner side surfaces of the slits 9, the inner surface of the recessed portion 7, the inner surface of the additional, recessed portion 8, the inner side surface of the additional slit 10, and the part of the upper surface U1 of the actuator substrate 2 near the second end Eb. Specifically, a catalyst is first selectively adsorbed on the outer surface of the cover plate 6 and the outer surface of the actuator substrate 2. Then, metal films are deposited on regions in which the catalyst is adsorbed by electroless plating method to thereby selectively form the conductive films 11. More specifically, the laminated substrate formed of the cover plate 6 and the actuator substrate 2 is immersed in a solution in which a palladium catalyst is dispersed and cleaned. Accordingly, the palladium catalyst is adsorbed on the roughened surface regions. On the other hand, the palladium catalyst is washed away from the mirror-finished surface regions. Then, the laminated substrate is sequentially immersed in an electroless nickel plating solution and an electroless gold plating solution. As a result, nickel and gold are deposited on the roughed surface regions on which the palladium catalyst is adsorbed, so that the conductive films 11 are formed thereon. On the other hand, nickel and gold are not deposited on the mirror-finished surface regions on which the palladium catalyst is not adsorbed, so that no conductive film 11 is formed thereon. In addition to nickel and gold, copper, silver, and other metals or alloys may be deposited by electroless plating method.

As a result, the common drive electrodes 12 (refer to FIG. 1) are formed on the side surfaces of the ejection grooves 3. The common wiring line 15 is formed on the inner side surfaces of the slits 9 and the inner surface of the recessed portion 7. The additional wiring line 16 is formed on the inner side surface of the additional slit 10 and the inner surface of the additional recessed portion 8. The wiring electrode 14 is formed on the inner surface of the wiring groove 5. The common terminal 18 is formed on the upper surface U1 of the actuator substrate 2 near the second end Eb as well as on the end region in the reference direction K. The common drive electrodes 12, the common wiring line 15, the additional wiring line 16, the wiring electrode 14, and the common terminal 18 are electrically connected to each other. Further, the individual drive electrodes 13 are formed on the side surfaces of the non-ejection grooves 4. The individual terminals 17 are formed on the upper surface U1 of the actuator substrate 2 near the second end Eb as well as between the ejection grooves 3 and the second end Eb. The individual drive electrodes 13 formed on the opposite side surfaces of each of the non-ejection grooves 4 are electrically separated from each other. On the other hand, each two of the individual drive electrodes 13 formed on the side surfaces of each two of the non-ejection grooves 4 between which each of the ejection grooves 3 is interposed, the side surfaces being located on side walls that define the interposed ejection groove 3, are electrically connected to the corresponding individual terminal 17.

As described above, it is necessary to electrically separate the individual drive electrodes 13 opposed in each of the non-ejection grooves 4 from each other. In order to achieve this configuration, for example, a glass material is used as the cover plate 6. Further, the lower surface L2 of the cover plate 6 is mirror-finished in the cover plate processing step S2. Accordingly, even when the lower surface L2 is immersed in the electroless plating solution, no conductive film 11 is deposited on the lower surface L2. As a result, no conductive film 11 is formed on the upper surfaces of the non-ejection grooves 4 (the lower surface L2 of the cover plate 6). Thus, it is possible to electrically separate the individual drive electrodes 13 opposed in each of the non-ejection grooves 4.

Further, in the electrode forming step S4, a mask, for example, a dry film may be adhered to the lower surface L1 of the actuator substrate 2 or the upper surface U2 of the cover plate 6 before performing electroless plating to thereby prevent the conductive film 11 to be deposited on the lower surface L1 or the upper surface U2 by the electroless plating. In this case, it is not necessary to previously mirror-finish the lower surface L1 of the actuator substrate 2 or the upper surface U2 of the cover plate 6. Further, in the electrode forming step S4, electroless plating may be first performed on the upper surface U2 of the cover plate 6 or the lower surface L1 of the actuator substrate 2, and the upper surface U2 of the cover plate 6 or the lower surface L1 of the actuator substrate 2 may then be ground to remove the deposited conductive film 11.

Then, as illustrated in FIG. 7 (s6), in the reinforcing plate bonding step S6, the reinforcing plate 19 is bonded to the lower surface L1 of the actuator substrate 2 with an adhesive. The same material as the actuator substrate 2, for example, a PZT ceramic material, a glass material, another insulating material, or a plastic material may be used as the reinforcing plate 19. Then, a nozzle plate 20 is adhered to end surfaces on the first side of the actuator substrate 2, the reinforcing plate 19, and the cover plate 6 which are formed flush with each other to allow the nozzles 21 formed on the nozzle plate 20 to communicate with the respective ejection grooves 3. The wiring groove 5 or the additional slit 10 is blocked by filling, for example, an adhesive therein to prevent liquid flowing into the recessed portion 7 from leaking to the outside.

In the liquid jet head 1 manufactured in the above manner, the common drive electrodes 12 (refer to FIG. 1), the common wiring line 15, the additional wiring line 16, the wiring electrode 14, and the common terminal 18 are electrically connected to each other. At the same time, the individual drive electrodes 13 and the individual terminals 17 are electrically connected to each other. Further, it is possible to achieve electrical separation between the individual terminals 17 and between the individual terminals 17 and the common terminal 18. In addition, alignment for electrode connection is not required. As a result, the electrode forming step is extremely simplified.

In the present embodiment, the common drive electrodes 12 formed on the ejection grooves 3 are electrically connected to the common terminal 18 through the common wiring line 15, the additional wiring line 16, and the wiring electrode 14. However, instead of this, the common terminal 18 may be disposed on the upper surface U2 of the cover plate 6. In this case, the wiring groove 5 is not formed in the groove forming step S1, and the additional recessed portion 8 and the additional slit 10 are not formed in the cover plate processing step S2. Alternatively, a roughened surface region continuous from the opening end of the recessed portion 7 is formed on the upper surface U2 of the cover plate 6. Then, a palladium catalyst may be adsorbed on the roughened surface region to form the common terminal 18 which is composed of, for example, a nickel film or a metal film by electroless plating method.

In the present embodiment, the liquid jet head 1 is an edge shoot type liquid jet head. However, instead of this, a side shoot type liquid jet head 1 may be formed. Specifically, in the groove forming step S1, the ejection grooves 3 are formed on the upper surface U1 of the actuator substrate 2 from the vicinity of the first end Ea up to the vicinity of the second end Eb thereof. In the cover plate processing step S2, a recessed portion and slits which communicate with ends on the first side of the ejection grooves 3 and a recessed portion and slits which communicate with ends on the second side of the ejection grooves 3 are formed. Then, instead of the reinforcing plate 19, the nozzle plate 20 is adhered to the lower surface L1 of the actuator substrate 2 to allow the nozzles 21 of the nozzle plate 20 to communicate with the respective ejection grooves 3.

A light transmissive substrate, for example, a glass material may be used as the cover plate 6 or the reinforcing plate 19. By using the light transmissive cover plate 6, for example, when a short circuit occurs in the conductive films 11 (the individual drive electrodes 13) on the opposite side surfaces of each of the non-ejection grooves 4 in the electrode forming step S4, it is possible to apply a laser beam to the short circuit part through the cover plate 6 or the reinforcing plate 19 to scatter the conductive film in the short circuit part, and thereby repair the short circuit.

In the present embodiment, the reinforcing plate bonding step S6 is performed after the electrode forming step S4. However, the reinforcing plate bonding step S6 may be performed before the electrode forming step S4. That is, the electrode forming step S4 of forming the conductive films 11 may be performed after the reinforcing plate 19 is bonded to the bonded body formed of the actuator substrate 2 and the cover plate 6. In this case, as described above, the individual drive electrodes 13 opposed in each of the non-ejection grooves 4 are required to be electrically separated from each other. In order to achieve this configuration, the reinforcing plate 19 is made of, for example, a glass material, and the surface of the reinforcing plate 19 is not roughened, but mirror-finished. Accordingly, no conductive film is formed on the surface of the reinforcing plate 19 by electroless plating method. Thus, no conductive film is formed on the bottom surfaces of the non-ejection grooves 4. As a result, it is possible to electrically separate the individual drive electrodes 13 opposed in each of the non-ejection grooves 4 from each other.

Fourth Embodiment

Figure 8:
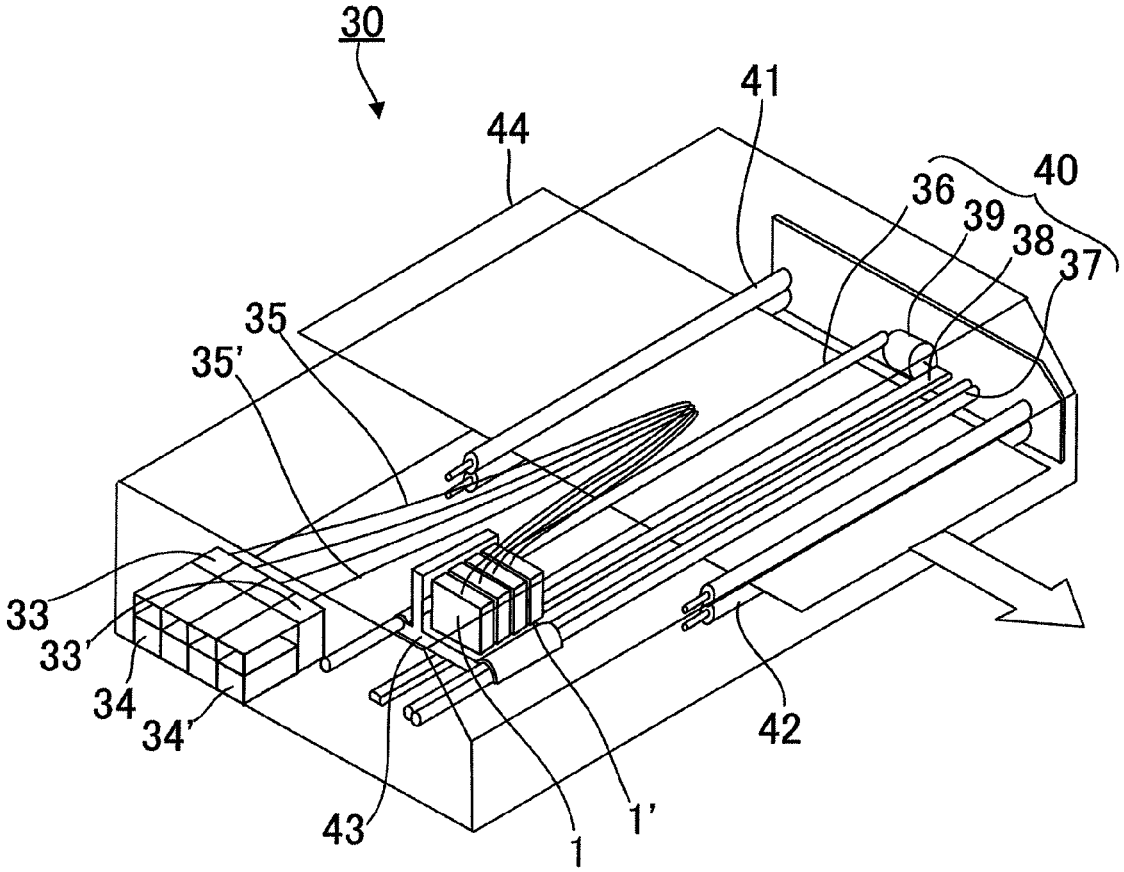
FIG. 8 is a schematic perspective view of a liquid jet apparatus according to a fourth embodiment of the present invention.
Figure 9:
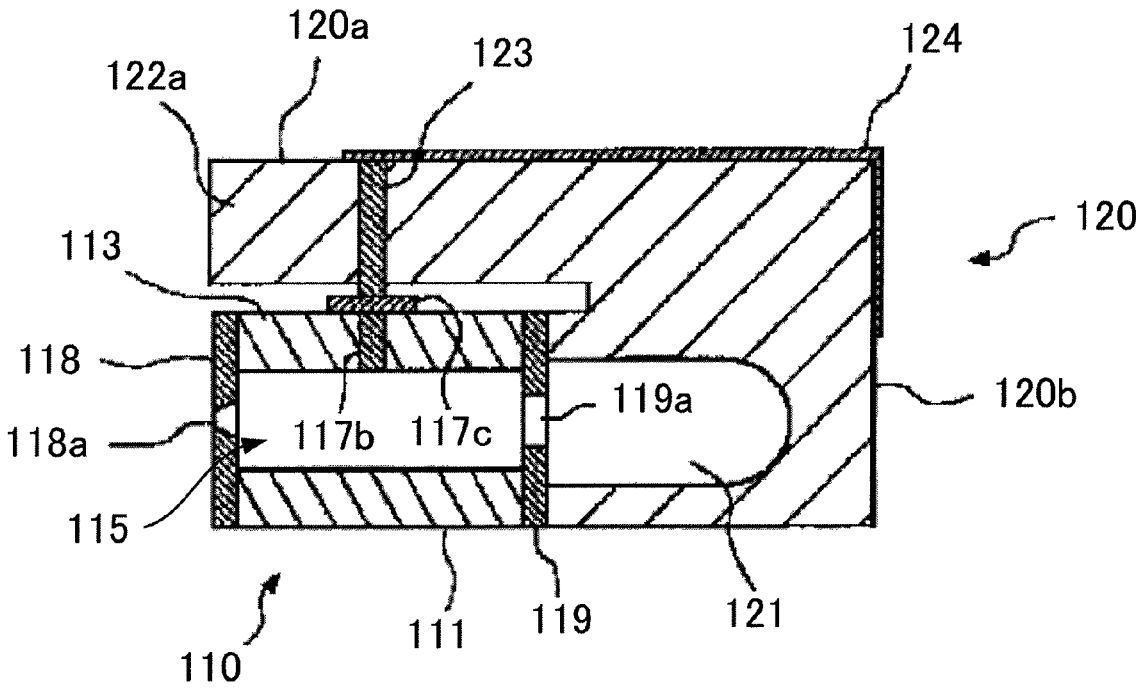
Fig.9 prior art
FIG. 9 is a schematic cross-sectional view of a conventionally known liquid jet head.

FIG. 8 is a schematic perspective view of a liquid jet apparatus 30 according to a fourth embodiment present invention. The liquid jet apparatus 30 is provided with a movement mechanism 40 which reciprocates liquid jet heads 1, 1', flow path portions 35, 35' which supply liquid to the liquid jet heads 1, 1' and discharge liquid from the liquid jet heads 1, 1', and liquid pumps 33, 33' and liquid tanks 34, 34' which communicate with the flow path portions 35, 35'. As the liquid pumps 33, 33', either or both of supply pumps which supply liquid to the flow path portions 35, 35' and discharge pumps which discharge liquid to components other than the flow path portions 35, 35' may be provided to circulate liquid. Further, a pressure sensor or a flow sensor (not illustrated) may be provided to control the flow rate of liquid. As each of the liquid jet heads 1, 1', the liquid jet head 1 of the first embodiment or the liquid jet head 1 manufactured by the manufacturing method of the second or third embodiment may be used.

The liquid jet apparatus 30 is provided with a pair of conveyance units 41, 42 which conveys a recording medium 44 such as paper in a main scanning direction, the liquid jet heads 1, 1' each of which jets liquid onto the recording medium 44, a carriage unit 43 on which the liquid jet heads 1, 1' are placed, the liquid pumps 33, 33' which supply liquid stored in the liquid tanks 34, 34' to the flow path portions 35, 35' by pressing, and the movement mechanism 40 which moves the liquid jet heads 1, 1' in a sub-scanning direction that is perpendicular to the main scanning direction. A control unit (not illustrated) controls the liquid jet heads 1, 1', the movement mechanism 40, and the conveyance units 41, 42 to drive.

Each of the conveyance units 41, 42 extends in the sub-scanning direction, and includes a grid roller and a pinch roller which rotate with the roller surfaces thereof making contact with each other. The grid roller and the pinch roller are rotated around the respective shafts by a motor (not illustrated) to thereby convey the recording medium 44 which is sandwiched between the rollers in the main scanning direction. The movement mechanism 40 is provided with a pair of guide rails 36, 37 each of which extends in the sub-scanning direction, the carriage unit 43 which is slidable along the pair of guide rails 36, 37, an endless belt 38 to which the carriage unit 43 is coupled to move the carriage unit 43 in the sub-scanning direction, and a motor 39 which revolves the endless belt 38 through a pulley (not illustrated).

The plurality of liquid jet heads 1, 1' are placed on the carriage unit 43. The liquid jet heads 1, 1' eject, for example, four colors of liquid droplets: yellow, magenta, cyan, and black. Each of the liquid tanks 34, 34' stores therein liquid of the corresponding color, and supplies the stored liquid to each of the liquid jet heads 1, 1' through each of the liquid pumps 33, 33' and each of the flow path portions 35, 35'. Each of the liquid jet heads 1, 1' jets liquid droplets of the corresponding color in response to a drive signal. Any patterns can be recorded on the recording medium 44 by controlling the timing of jetting liquid from the liquid jet heads 1, 1', the rotation of the motor 39 which drives the carriage unit 43, and the conveyance speed of the recording medium 44.

In the liquid jet apparatus 30 of the present embodiment, the movement mechanism 40 moves the carriage unit 43 and the recording medium 44 to perform recording. However, instead of this, the liquid jet apparatus may have a configuration in which a carriage unit is fixed, and a movement mechanism two-dimensionally moves a recording medium to perform recording. That is, the movement mechanism may have any configuration as long as it relatively moves the liquid jet head and a recording medium.

What is claimed is:

1. A method of manufacturing a liquid jet head comprising:

a groove forming step of alternately forming ejection grooves and non-ejection grooves in a reference direction on an upper surface of an actuator substrate;

a cover plate processing step of forming a recessed portion on an upper surface of a cover plate and slits penetrating the cover plate from a bottom surface of the recessed portion through a lower surface of the cover plate;

a substrate bonding step of bonding the lower surface of the cover plate to the upper surface of the actuator substrate to allow the slits to communicate with the respective ejection grooves; and an electrode forming step of simultaneously forming conductive films on side surfaces of the ejection grooves, side surfaces of the non-ejection grooves, inner side surfaces of the slits, and an inner surface of the recessed portion.

2. The method of manufacturing the liquid jet head according to claim 1, wherein the substrate bonding step includes bonding the cover plate to the actuator substrate in a manner to allow a part of the upper surface of the actuator substrate and a part of each of the non-ejection grooves to be exposed, and the electrode forming step includes simultaneously forming the conductive films on the exposed part of the upper surface of the actuator substrate.

3. The method of manufacturing the liquid jet head according to claim 1, wherein the electrode forming step includes forming the conductive films by plating.

4. The method of manufacturing the liquid jet head according to claim 1, wherein the cover plate processing step includes a step of mirror-finishing the upper surface of the cover plate and roughening the inner surface of the recessed portion and the inner side surfaces of the slits.

5. The method of manufacturing the liquid jet head according to claim 1, wherein the cover plate processing step includes a step of mirror-finishing the lower surface of the cover plate.

6. The method of manufacturing the liquid jet head according to claim 1, wherein the groove forming step includes forming a wiring groove in parallel to the non-ejection grooves, the cover plate processing step includes further forming an additional recessed portion communicating with the recessed portion on the upper surface of the cover plate and an additional slit penetrating the cover plate from a bottom surface of the additional recessed portion through the lower surface opposite to the upper surface of the cover plate, the substrate bonding step includes allowing the additional slit to communicate with the wiring groove, and the electrode forming step includes simultaneously forming the conductive films on an inner surface of the wiring groove, an inner surface of the additional recessed portion, and an inner side surface of the additional slit.

7. The method of manufacturing the liquid jet head according to claim 1, wherein the cover plate is a light transmissive substrate.

8. A liquid jet head comprising:

an actuator substrate having ejection grooves and non-ejection grooves alternately arrayed in a reference direction;

a cover plate bonded to the actuator substrate, the cover plate having a recessed portion on an upper surface thereof and slits penetrating the cover plate from a bottom surface of the recessed portion through a lower surface of the cover plate and communicating with the respective ejection grooves;

common drive electrodes formed on side surfaces of the ejection grooves;

individual drive electrodes formed on side surfaces of the non-ejection grooves; and a common wiring line formed on inner side surfaces of the slits and an inner surface of the recessed portion, wherein the common drive electrodes formed on the ejection grooves are electrically connected to each other through the common wiring line.

9. The liquid jet head according to claim 8, wherein the non-ejection grooves are formed from a first end of the actuator substrate through a second end thereof, the ejection grooves are formed from the first end of the actuator substrate up to the vicinity of the second end thereof, the cover plate is bonded to an upper surface of the actuator substrate in a manner to allow the slits to communicate with the respective ejection grooves, individual terminals are formed on the upper surface of the actuator substrate near the second end thereof, and each of the individual terminals is configured to electrically connect each two of the individual drive electrodes formed on each two of the non-ejection grooves adjacent to each other with each of the ejection grooves interposed therebetween.

10. The liquid jet head according to claim 8, wherein the inner surface of the recessed portion and the inner side surfaces of the slits are roughened.

11. The liquid jet head according to claim 8, wherein the actuator substrate includes a wiring groove formed near an end in the reference direction, a wiring electrode formed on an inner surface of the wiring groove, and a common terminal formed on the upper surface on which the wiring groove is open, the cover plate includes an additional recessed portion communicating with the recessed portion, an additional slit penetrating the cover plate from a bottom surface of the additional recessed portion through the lower surface of the cover plate and communicating with the additional recessed portion, and an additional wiring line formed on an inner surface of the additional recessed portion and an inner side surface of the additional slit, and the common terminal is electrically connected to the common wiring line through the wiring electrode and the additional wiring line.

12. The liquid jet head according to claim 8, wherein the actuator substrate includes individual terminals electrically connected to the individual drive electrodes and a common terminal electrically connected to the common wiring line, and the common terminal is formed on an upper surface of the actuator substrate on an end in the reference direction, and the individual terminals are formed on the upper surface of the actuator substrate on an inner side in the reference direction with respect to the common terminal.

13. The liquid jet head according to claim 8, wherein the cover plate is a light transmissive substrate.

14. A liquid jet apparatus comprising:

the liquid jet head according to claim 8;

a movement mechanism configured to relatively move the liquid jet head and a recording medium;

a liquid supply tube configured to supply liquid to the liquid jet head; and a liquid tank configured to supply the liquid to the liquid supply tube.

* * * * *